US007578931B2

(12) United States Patent
Zhu

(10) Patent No.: US 7,578,931 B2
(45) Date of Patent: Aug. 25, 2009

(54) PRESSURE RELEASE PROTECTION DEVICE FOR AUTOMATIC GROUND CLEANING VEHICLES

(76) Inventor: Ruizhen Zhu, No. 24, Shijing Road, Dongcheng District, Dongguan, Guangdong (CN) 523000

( * ) Notice: Subject to any disclaimer, the term of this patent is extended or adjusted under 35 U.S.C. 154(b) by 0 days.

(21) Appl. No.: 11/762,213

(22) Filed: Jun. 13, 2007

(65) Prior Publication Data

US 2007/0283671 A1 Dec. 13, 2007

(30) Foreign Application Priority Data

Jun. 13, 2006 (CN) ..... 2006 2 0060275 U

(51) Int. Cl.
*B01D 35/02* (2006.01)

(52) U.S. Cl. ..... 210/120; 210/123; 210/241; 210/430; 210/459; 15/320; 15/340.1; 134/104.4; 134/110; 137/202; 137/526; 137/587; 251/322

(58) Field of Classification Search ..... 210/120, 210/121, 123, 241, 429, 430, 459; 15/320, 15/340.1, 353; 134/104.4, 110; 251/321, 251/322; 137/202, 526, 587
See application file for complete search history.

(56) References Cited

U.S. PATENT DOCUMENTS 2,533,395 A * 12/1950 Paine ..... 15/353
4,213,479 A * 7/1980 Pearson ..... 210/241
4,801,376 A * 1/1989 Kulitz ..... 210/123
4,917,795 A * 4/1990 Sable et al. ..... 210/120
4,939,809 A * 7/1990 Park ..... 15/353
5,493,753 A * 2/1996 Rostamo ..... 15/353
5,720,885 A * 2/1998 Moos ..... 210/241
6,839,933 B2 * 1/2005 Wheeler et al. ..... 15/320
6,912,757 B2 * 7/2005 Kaufman et al. ..... 15/320
2004/0211024 A1 * 10/2004 Cho ..... 15/353
2006/0236498 A1 * 10/2006 Nuhn ..... 15/340.1

* cited by examiner

*Primary Examiner*—Christopher Upton
(74) *Attorney, Agent, or Firm*—Matthias Scholl P.C.; Matthias Scholl

(57) ABSTRACT

The present invention teaches a pressure release protection device for automatic ground cleaning vehicles, comprising an air suction pipe, an airtight cover, an air relief valve, a spring, a filter screen, a filter screen holder, a crown bar, a floating ball, and a foam isolating bucket, wherein the filter screen holder is fixed connected to the upper wall of the waste water tank, and the filter screen is fixed connected to the filter screen holder; the foam isolating bucket is connected to the filter screen holder; the floating ball is disposed inside of the foam isolating bucket and is connected to the crown bar; the crown bar is installed into the central hole of the filter screen holder, and can slide up and down with the floating of the floating ball; said airtight cover serves to cover the top of the waste water tank; the air relief valve comprises a handle part and a tubular shank part, wherein the shank part is installed into the central hole of the airtight cover. The pressure release protection device of the present invention can protect the automatic ground cleaning vehicle effectively and increases the work efficiency of the automatic ground cleaning vehicle.

5 Claims, 2 Drawing Sheets

PRESSURE RELEASE PROTECTION DEVICE FOR AUTOMATIC GROUND CLEANING VEHICLES

CROSS-REFERENCE TO RELATED APPLICATIONS

Pursuant to 35 U.S.C. § 119 and the Paris Convention Treaty, this application claims the benefit of Chinese Patent Application No. 200620060275.5 filed Jun. 13, 2006, the contents of which are incorporated herein by reference.

BACKGROUND OF THE INVENTION

1. Field of the Invention

The invention relates to hard ground cleaning devices, more particularly, to an automatic ground cleaning vehicle.

2. Description of the Related Art

An automatic ground cleaning vehicle generally comprises a cleaning member and a stain suction member. The stain suction member comprises a suction pump, an air suction pipe connected to the suction pump, a water wiper, a stain suction pipe connected to the water wiper, a floating ball, a waste water tank, and an airtight cover serving to cover the top of the waste water tank. When the suction pump is being rotated, a suction pressure is formed inside of the waste water tank, then the stains, which mainly include dust contained waste water and foam, on the ground is sucked into the waste water tank through the stain suction pipe. However, when in use, the suction pump is often burnt out due to the water or foam sucked therein, this is especially serious when high sudsing detergent is used. The original way to eliminate this risk is to lower the liquid level of the waste water tank, however, by this way, the utilization of the waste water tank capacity is decreased, and thereby the working cycle of the waste water tank is shortened. FIG. 4 illustrates a superstructure of a waste water tank of an existing automatic ground cleaning vehicle, the liquid level of the waste water tank is controlled by means of a block sealing method. Namely, when the liquid level of the waste water tank rises to a certain height, the floating ball is catched up by the suction mouth, the suction pressure inside of the waste water tank is then released, the water wiper loses its capability to suck the waste water so that the liquid level of the waste water tank is controlled. However, especially in a noisy environment, even an experienced operate is difficult to differentiate the voice when the suction pump is blocked compared with the voice when the suction pump is not blocked, to say nothing of a fresh operator.

SUMMARY OF THE INVENTION

Therefore, it is one objective of the invention to provide a pressure release protection device for automatic ground cleaning vehicles capable of protecting the vehicle and increasing the work efficiency of the vehicle.

To achieve the above objective, provided a pressure release protection device for automatic ground cleaning vehicles, comprising an air suction pipe, an airtight cover, an air relief valve, a spring, a filter screen, a filter screen holder, a crown bar, a floating ball, and a foam isolating bucket, wherein said filter screen holder is fixed connected to the upper wall of the waste water tank, and said filter screen is fixed connected to the filter screen holder; said foam isolating bucket is connected to the filter screen holder and is located inside of the waste water tank; said floating ball is disposed inside of the foam isolating bucket and is connected to the crown bar; said crown bar is installed into the central hole of the filter screen holder, and can slide up and down with the floating of the floating ball; said airtight cover serves to cover the top of the waste water tank and is located on top of the filter screen holder, and comprises a cover shell and a central hole, wherein a seal groove for accommodating a seal gasket is formed on the cover shell; said air relief valve comprises a handle part and a tubular shank part, wherein the shank part is installed into the central hole of the airtight cover, a circular groove for housing the spring cushion is formed at the lower portion of the shank part; said spring is fit installed around the outer wall of the central hole of the airtight cover, wherein the two ends of the spring are contacted with the spring cushion and the inner wall surface of the cover shell of the airtight cover, respectively.

In certain embodiments of the invention, an air escape hole is opened on the shank part of said air relief valve. A circular groove for housing an O-shaped seal ring is formed on the handle part of said air relief valve.

In certain embodiments of the invention, said filter screen holder has a double barrel structure, comprising an outer barrel, an inner barrel, and a central hole, the filter screen is combined with the outer barrel and is fixed connected to the lower portion of the end face of the filter screen holder, the foam isolating bucket is connected with the outer barrel.

As a result, the pressure release protection device for automatic ground cleaning vehicle of the present invention provides the following advantages:

1) it utilizes the buoyancy of water, the floating ball rises to open the air relief valve so as to make the waste water tank lose its suction pressure, then the water wiper loses its capability to suck waste water so that the liquid level of the waste water tank is controlled. Besides, an unusual voice is generated when the air relief valve is opened so as to remind the operator that the water needs to be discharged. Therefore, the suction pump will not be burnt out even it is operated by a fresh operator. Besides, even the operator does not hear the air release voice, the suction pump can also not be burnt out since it can be operated continuously for tens of hours if the suction pump is not blocked;
2) it can separate the water and the foam automatically, the foam is blocked away from the suction channel so that the precision and stability about the rise of the floating ball is ensured, and the suction pump is avoided from sucking in light foam;
3) the suction pump will not suck any water or foam in under the conditions of any environment and using any high sudsing detergent;
4) it can compress the space of the foam layer, so that the capacity of the waste water tank is used maximally, the working cycle of the automatic ground cleaning vehicle is lengthened, and the work efficiency is increased.

The working principle of the pressure release protection device of the present invention is as below: when starting the suction pump, a suction pressure is formed inside of the waste water tank, the water wiper then sucks the waste water and foam on the ground into the waste water tank. When the liquid level rises to its predetermined level, the floating ball transfers the buoyancy of water to the air relief valve through the crown bar. When the buoyancy of water is bigger than the spring pressure, the air relief valve is opened so that the pressure inside of the waste water tank equals to its ambient pressure, the water wiper then loses its capability to suck waste water, the liquid level of the waste water tank then stops rising so as to ensure that the waste water and foam inside of the waste water tank will not be sucked into the suction pump.

DETAILED DESCRIPTION OF THE EMBODIMENTS

The objects and advantages of the invention will become more readily apparent after reading the ensuing descriptions of the non-limiting illustrative embodiment and viewing the accompanying drawings.

Figure 1:
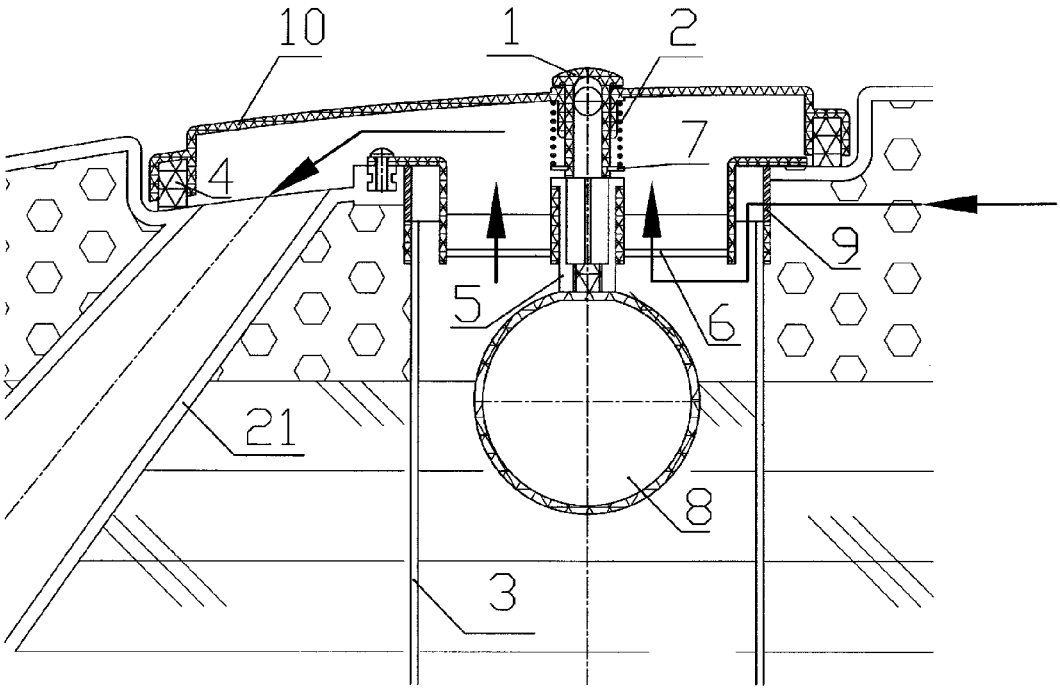
FIG. 1 is a structural view of a pressure release protection device for automatic ground cleaning vehicles of the present invention.
Figure 2:
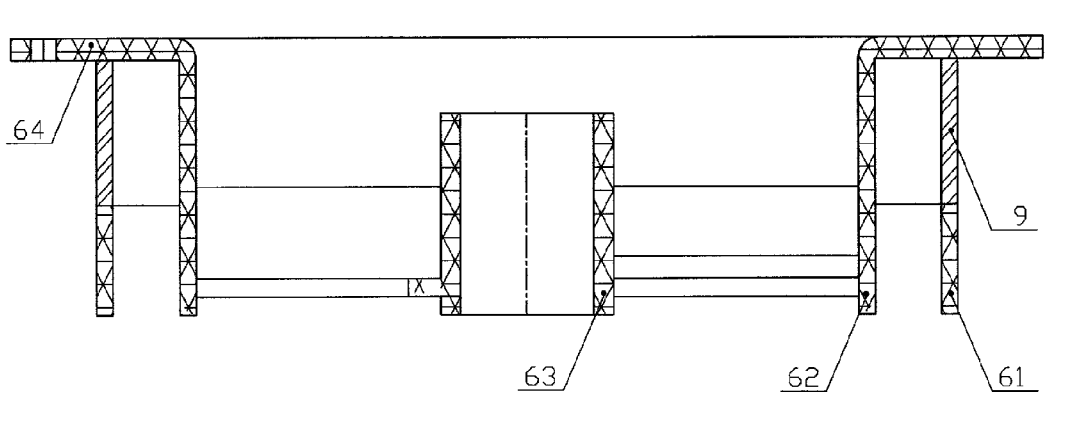
FIG. 2 is a structural view of a filter screen holder of the present invention.
Figure 3:
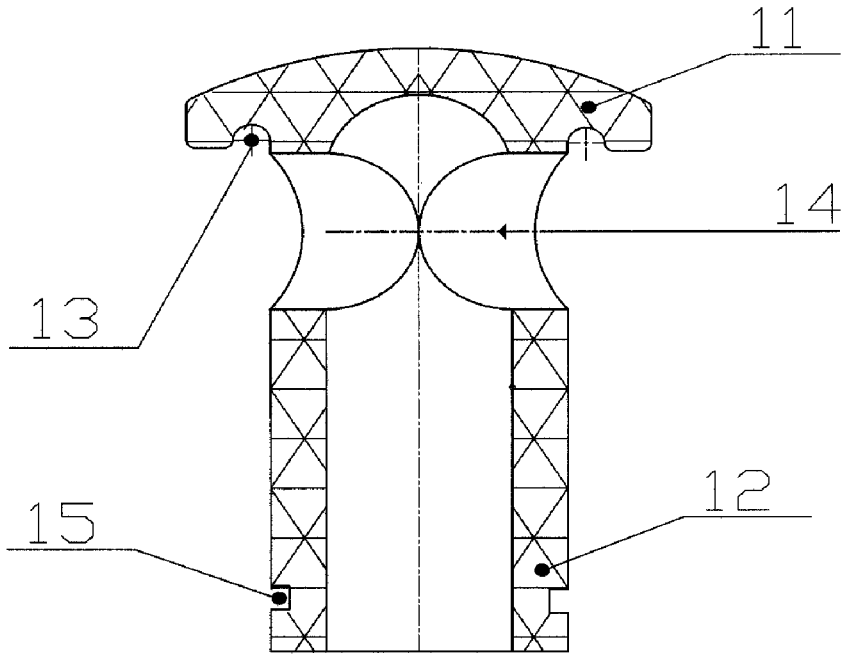
FIG. 3 is a structural view of an air relief valve of the present invention.
Figure 4:
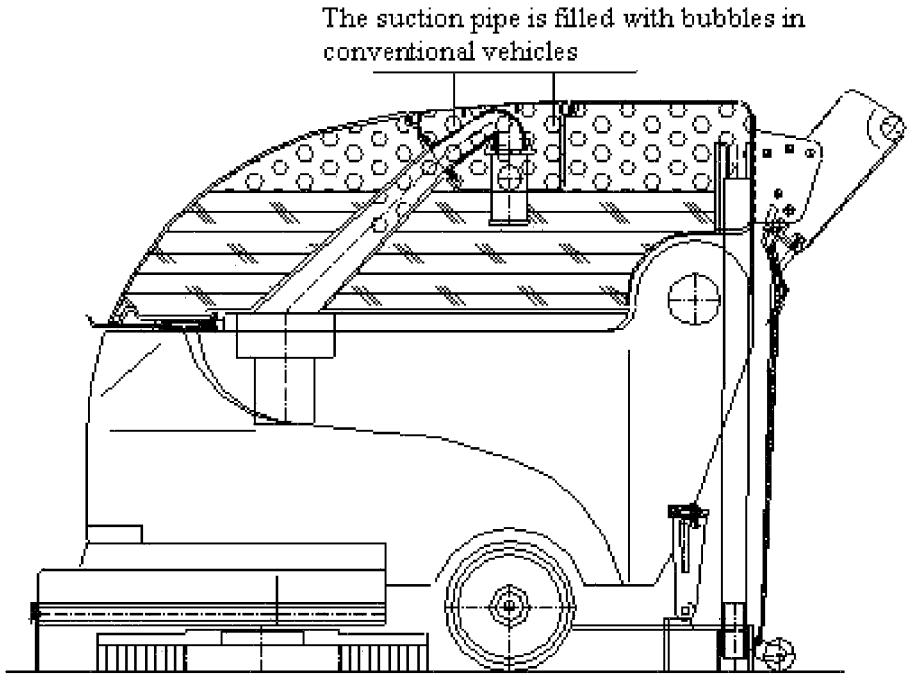
Fig.4 PRIOR ART
FIG. 4 illustrates a superstructure of a waste water tank of an existing automatic ground cleaning vehicle.

With reference to FIGS. 1-3, a pressure release protection device for automatic ground cleaning vehicles is installed on top of the waste water tank of an automatic ground cleaning vehicle, and comprises an air suction pipe 21, an airtight cover 10, an air relief valve 1, a spring 2, a filter screen 9, a filter screen holder 6, a crown bar 5, a floating ball 8, and a foam isolating bucket 3. The arrow direction illustrated in FIG. 1 indicates the flow direction of fluid such as air or liquid.

In the present embodiment, said filter screen holder 6 is fixed connected to the upper wall of the waste water tank, and said filter screen 9 is fixed connected to the filter screen holder 6; said foam isolating bucket 3 is connected to the filter screen holder 6 and is located inside of the waste water tank; said floating ball 8 is disposed inside of the foam isolating bucket 3 and is connected to the crown bar 5; said crown bar 5 is installed into the central hole 63 of the filter screen holder 6, and can slide up and down with the floating of the floating ball 8; said airtight cover 10 serves to cover the top of the waste water tank and is located on top of the filter screen holder 6, and comprises a cover shell and a central hole, wherein a seal groove for accommodating a seal gasket 4 is formed on the cover shell; said air relief valve 1 comprises a handle part 11 and a tubular shank part 12, wherein the shank part 12 is installed into the central hole of the airtight cover 10, a circular groove 15 for housing the spring cushion 7 is formed at the lower portion of the shank part; said spring 2 is fit installed around the outer wall of the central hole of the airtight cover, wherein the two ends of the spring 2 are contacted with the spring cushion 7 and the inner wall surface of the cover shell of the airtight cover, respectively.

FIG. 2 is a structural view of a filter screen holder 6 of the present invention. The filter screen holder 6 has a double barrel structure, comprising an outer barrel 61, an inner barrel 62, and a central hole 63, the filter screen 9 is combined with the outer barrel 61 and is fixed connected to the lower portion of the end face 64 of the filter screen holder, the foam isolating bucket 3 is fixed connected with the outer barrel 61.

FIG. 3 is a structural view of an air relief valve 1 of the present invention, wherein an air escape hole 14 is formed on the shank part 12 of the air relief valve 1. A circular groove 13 for housing an O-shaped seal ring is formed on the handle part 11 of said air relief valve 1.

In the present embodiment, said filter screen is a 300-mesh stainless steel screen, when the foam sucked in strikes said screen, it ruptures in water.

In the present embodiment, said floating ball 8 is connected with the crown bar 5 by means of threads. When the liquid level inside of the waste water tank rises, the floating ball rises to drive the crown bar to move upward, the top end face of the crown bar contacts the lowest end face of the shank part 12 of the air relief valve 1. If the crown bar continues to rise, and when the buoyancy of water is bigger than the pressure of the spring 2, the air relief valve will be opened so that the waste water tank is connected to the atmosphere, and thereby, the waster water tank loses its suction pressure.

What is claimed is:

1. A pressure release device for a ground cleaning vehicle having a wastewater tank with an air suction pipe and an airtight cover, the pressure release device comprising: an air relief valve, a spring, a filter screen, a filter screen holder having a central hole, a crown bar, a floating ball, and a foam isolating bucket; wherein said filter screen holder is fixedly connected to an upper wall of the wastewater tank, and said filter screen is fixedly connected to said filter screen holder;

said foam isolating bucket is connected to said filter screen holder and is located inside of the wastewater tank;

said floating ball is disposed inside of said foam isolating bucket and is connected to said crown bar;

said crown bar is installed in said central hole of the filter screen holder, and can slide up and down with the floating of the floating ball;

said air relief valve is actuated by said crown bar within said central hole of said filter screen holder;

said filter screen is connected to said upper wall of said wastewater tank and fits tightly around said foam isolating bucket;

said airtight cover serves to cover the top of the wastewater tank and is located on top of the filter screen holder, and comprises a cover shell and a central hole, wherein a seal groove for accommodating a seal gasket is formed on the cover shell;

said air relief valve comprises a handle part and a tubular shank part, wherein the shank part is installed into the central hole of the airtight cover, a circular groove for housing a spring cushion is formed at the lower portion of the shank part; and said spring is fit installed around the outer wall of the central hole of the airtight cover, wherein the two ends of the spring are contacted with the spring cushion and the inner wall surface of the cover shell of the airtight cover, respectively.

2. The protection device of claim 1, wherein an air escape hole is opened on the shank part of said air relief valve.

3. The protection device of claim 1, wherein a circular groove for housing an O-shaped seal ring is formed on the handle part of said air relief valve.

4. The protection device of claim 1, wherein said filter screen holder has a double-barrel structure, comprising an outer barrel, an inner barrel, and said central hole of said filter screen holder, the filter screen is combined with the outer barrel and is fixedly connected to the lower portion of the end face of the filter screen holder, and the foam isolating bucket is fixedly connected with the outer barrel.

5. A pressure release device for a ground cleaning vehicle having a wastewater tank with an air suction pipe and an airtight cover, the pressure release device comprising: a filter screen holder with a foam isolating bucket and a screen connected to an upper wall of the wastewater tank, a floating ball connected to a crown bar within a central hole of the filter screen holder and within the foam isolating bucket, and a spring biased air relief valve actuated by the crown bar within a central hole of the airtight cover.

* * * * *